US011046545B2

(12) United States Patent
Tanaka

(10) Patent No.: US 11,046,545 B2
(45) Date of Patent: Jun. 29, 2021

(54) SHEET CONVEYING DEVICE AND IMAGE FORMING APPARATUS INCORPORATING THE SHEET CONVEYING DEVICE

(71) Applicant: Mizuna Tanaka, Tokyo (JP)

(72) Inventor: Mizuna Tanaka, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/901,008

(22) Filed: Jun. 15, 2020

(65) Prior Publication Data

US 2021/0024317 A1 Jan. 28, 2021

(30) Foreign Application Priority Data

Jul. 26, 2019 (JP) ..... JP2019-137733

(51) Int. Cl.
*B65H 29/58* (2006.01)
*B65H 5/06* (2006.01)
*B65H 45/12* (2006.01)

(52) U.S. Cl.
CPC ..... *B65H 29/58* (2013.01); *B65H 5/062* (2013.01); *B65H 45/12* (2013.01); *B65H 2701/1311* (2013.01)

(58) Field of Classification Search
CPC . B65H 29/58; B65H 29/60; B65H 2701/1311
USPC ..... 271/184, 225
See application file for complete search history.

(56) References Cited

U.S. PATENT DOCUMENTS

| | | | | |
|---|---|---|---|---|
| 6,394,446 | B1 * | 5/2002 | Okamoto | B65H 29/58 271/186 |
| 8,708,481 | B2 * | 4/2014 | Ito | B65H 29/58 347/104 |
| 10,625,969 | B2 * | 4/2020 | Shimamura | B65H 29/70 |
| 2011/0115154 | A1 | 5/2011 | Fujiwara et al. | |
| 2011/0127707 | A1 | 6/2011 | Honda et al. | |
| 2011/0204556 | A1 | 8/2011 | Takahira et al. | |
| 2011/0285076 | A1 | 11/2011 | Fujiwara et al. | |
| 2011/0291353 | A1 | 12/2011 | Fujiwara et al. | |
| 2012/0104685 | A1 | 5/2012 | Nishii et al. | |
| 2012/0104690 | A1 | 5/2012 | Tanaka et al. | |

(Continued)

FOREIGN PATENT DOCUMENTS

| | | |
|---|---|---|
| JP | 4-246055 | 9/1992 |
| JP | 2016-044046 | 4/2016 |

*Primary Examiner* — Leslie A Nicholson, III
(74) *Attorney, Agent, or Firm* — Xsensus LLP

(57) ABSTRACT

A sheet conveying device includes a first sheet conveyance passage, a second sheet conveyance passage, and a branching guide. The first sheet conveyance passage is a passage through which a sheet passes in a first direction. The second sheet conveyance passage shares a part of the first sheet conveyance passage and branches off from the first sheet conveyance passage in a second direction opposite the first direction of the first sheet conveyance passage. The branching guide is disposed at a position where the first sheet conveyance passage meets the second sheet conveyance passage. The branching guide is configured to move between a first position for the first direction and a second position for the second direction. A plurality of branching guides including the branching guide is spaced apart in a width direction of the sheet and separately switchable between the first position and the second position.

17 Claims, 10 Drawing Sheets

(56) References Cited

U.S. PATENT DOCUMENTS

| | | | |
|---|---|---|---|
| 2012/0146281 | A1 | 6/2012 | Nishii et al. |
| 2013/0207335 | A1 | 8/2013 | Nishioka et al. |
| 2014/0049000 | A1 | 2/2014 | Kimura et al. |
| 2014/0077444 | A1 | 3/2014 | Fujii et al. |
| 2014/0103603 | A1 | 4/2014 | Horita et al. |
| 2014/0319759 | A1 | 10/2014 | Fujii et al. |
| 2015/0259164 | A1 | 9/2015 | Horita et al. |
| 2015/0274450 | A1 | 10/2015 | Fujii et al. |
| 2015/0274452 | A1 | 10/2015 | Tanaka et al. |
| 2016/0109841 | A1 | 4/2016 | Horita et al. |
| 2016/0378042 | A1 | 12/2016 | Tanaka et al. |

* cited by examiner

SHEET CONVEYING DEVICE AND IMAGE FORMING APPARATUS INCORPORATING THE SHEET CONVEYING DEVICE

CROSS-REFERENCE TO RELATED APPLICATION

This patent application is based on and claims priority pursuant to 35 U.S.C. § 119(a) to Japanese Patent Application No. 2019-137733, filed on Jul. 26, 2019, in the Japan Patent Office, the entire disclosure of which is hereby incorporated by reference herein.

BACKGROUND

Technical Field

This disclosure relates to a sheet conveying device and an image forming apparatus incorporating the sheet conveying device.

Discussion of the Background Art

Various types of sheet conveying devices are known to include a first sheet conveyance passage through which a sheet passes in a first direction, a second sheet conveyance passage that shares a part of the first sheet conveyance passage and branches off from the first sheet conveyance passage in a second direction opposite the first direction of the part of the first sheet conveyance passage, and a conveyance passage branching guide disposed at a position where the first sheet conveyance passage meets the second sheet conveyance passage. The conveyance passage branching guide is switchable between a first position at which the sheet is guided in the first direction and a second position at which the sheet is guided in the second direction.

SUMMARY

At least one aspect of this disclosure provides a sheet conveying device including a first sheet conveyance passage, a second sheet conveyance passage, and a branching guide. The first sheet conveyance passage is a passage through which a sheet passes in a first direction. The second sheet conveyance passage shares a part of the first sheet conveyance passage and branches off from the first sheet conveyance passage in a second direction opposite the first direction of the first sheet conveyance passage. The branching guide is disposed at a position where the first sheet conveyance passage meets the second sheet conveyance passage. The branching guide is configured to move between a first position in which the sheet is guided in the first direction and a second position in which the sheet is guided in the second direction. A plurality of branching guides including the branching guide is spaced apart in a width direction of the sheet and separately switchable between the first position and the second position.

Further, at least one aspect of this disclosure provides an image forming apparatus including an image forming device configured to form an image on a sheet, and the above-described sheet conveying device configured to convey the sheet.

BRIEF DESCRIPTION OF THE SEVERAL VIEWS OF THE DRAWINGS

An exemplary embodiment of this disclosure will be described in detail based on the following figured, wherein.

Figure 1:
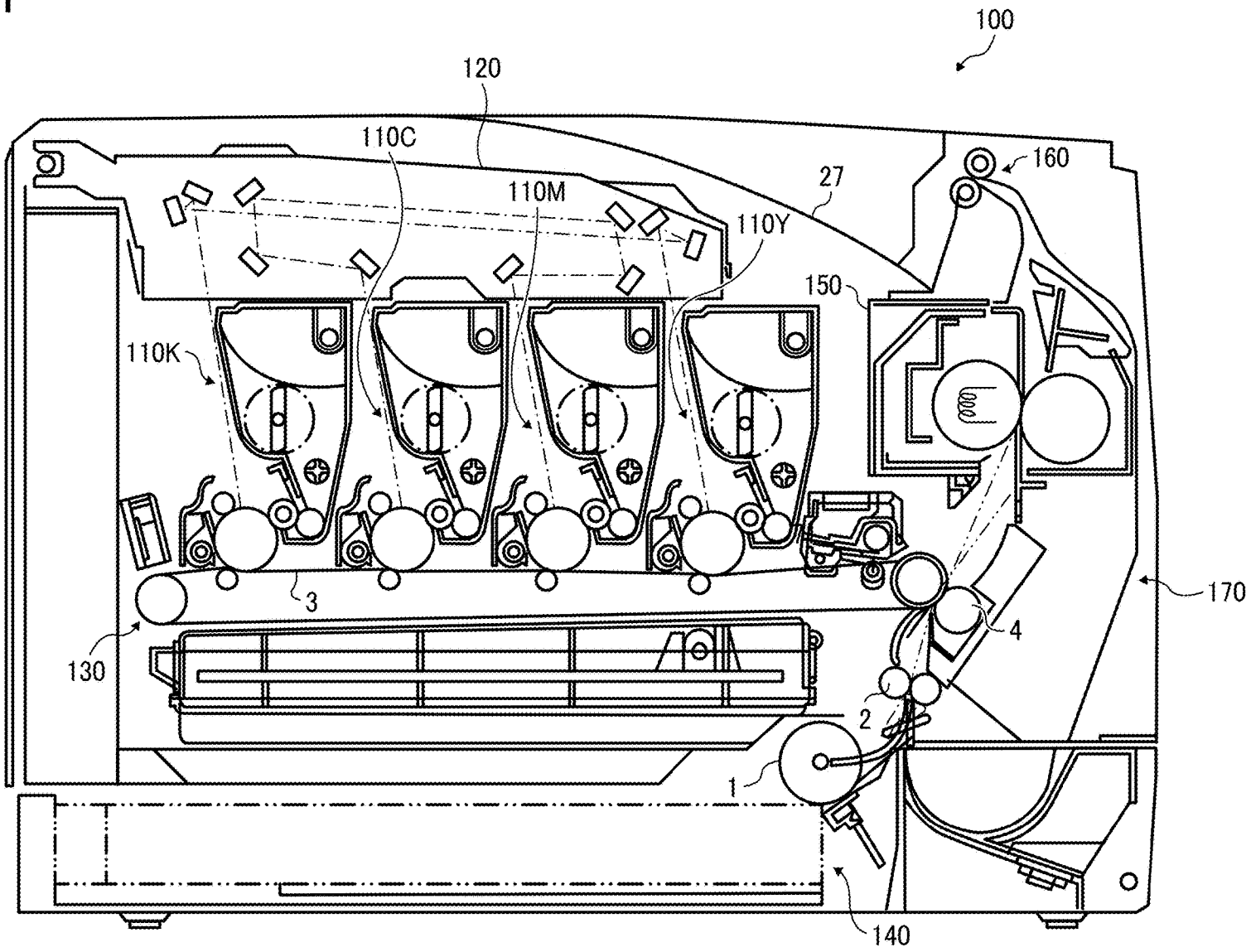
FIG. 1 is a diagram illustrating a schematic configuration of an image forming apparatus according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

In the following description, the term "image forming apparatus" refers to an image forming apparatus that performs image formation by attaching developer or ink to a medium such as paper, OHP sheet, yarn, fiber, cloth, leather, metal, plastic, glass, wood, ceramics and the like. Further, it is to be noted that the term "image formation" indicates an action for providing (i.e., printing) not only an image having meanings such as texts and figures on a recording medium but also an image having no meaning such as patterns on a recording medium. Further, it is to be noted that the term "sheet" is not limited to indicate a paper sheet but also includes OHP transparency sheet, cloth, and a material which is called as a recording target medium, a recording medium, a recording sheet, or a recording paper, and is used to which the developer or ink is attracted. In the above-described embodiment, a sheet material is described as the "sheet", and the dimensions, the materials, the shapes, the relative arrangements, and the like described for the respective component are examples, and the scope of the present disclosure is not intended to be limited thereto unless otherwise particularly specified. Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

Now, a description is given of an image forming apparatus 100 according to an embodiment of this disclosure. Further, the image forming apparatus 100 is not limited to an electrophotographic image forming apparatus but may be a non-electrophotographic image forming apparatus such as an inkjet type image forming apparatus.

FIG. 1 is a diagram illustrating the image forming apparatus 100 according to an embodiment of this disclosure.

As illustrated in FIG. 1, the image forming apparatus 100 includes four image forming units 110K, 110C, 110M, and 110Y (collectively, an image forming unit 110) for forming toner images of black (K), cyan (C), magenta (M), and yellow (Y), respectively. The suffixes K, C, M and Y added to the end of the reference numerals assigned to the respective parts correspond to the respective colors. The image forming apparatus 100 further includes an optical writing unit 120, an intermediate transfer belt unit 130, a sheet feeding device 140, a fixing device 150, a sheet ejecting device 160, and a sheet reentry device 170.

The image forming unit 110 includes a photoconductor that functions as an image bearer, a charger, a developing unit, a primary transfer unit, and a cleaning unit.

In image formation, the charger uniformly charges the surface of the photoconductor with electric potential, the optical writing unit 120 forms a latent image on the charged surface of the photoconductor, the developing unit develops the latent image to a visible toner image, and the primary transfer unit transfers the toner image onto an intermediate transfer belt 3 of the intermediate transfer belt unit 130. The cleaning unit cleans the surface of the photoconductor by removing residual toner remaining on the surface of the photoconductor. The charge eliminating unit eliminates residual electric potential, that is, resets the value of residual electric potential to zero (0).

Then, the toner image formed on the surface of the intermediate transfer belt 3 is transferred onto a sheet 20 as a sheet material that is conveyed in a sheet conveying device 200.

Note that the image forming unit 110, the optical writing unit 120, and the intermediate transfer belt unit 130 are units for forming a toner image on the intermediate transfer belt 3 and are included in an image forming device.

Figure 2:
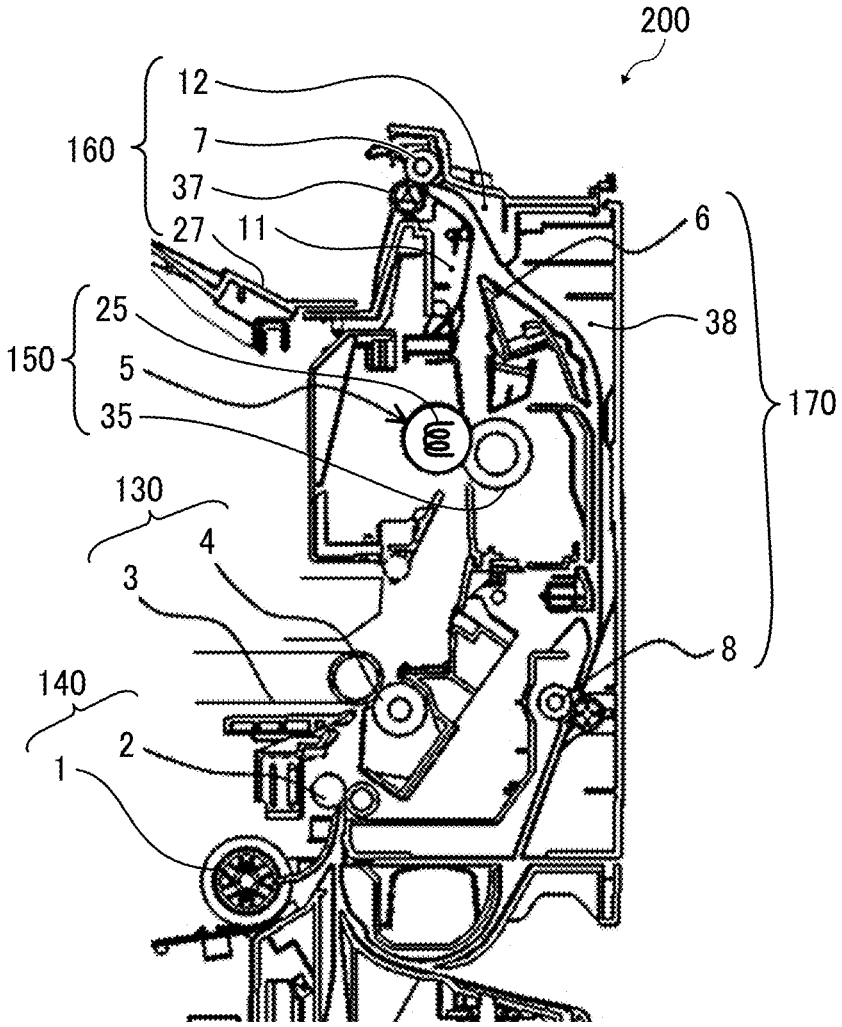
FIG. 2 is a diagram illustrating a schematic configuration of a sheet conveying device.

FIG. 2 is a diagram illustrating a schematic configuration of the sheet conveying device 200.

The sheet P is fed by a sheet feed roller 1 of the sheet feeding device 140 and is conveyed to a pair of registration rollers 2, where the sheet P stands by while being bent (warped) by a given amount. While the sheet P stands by, the toner image is conveyed by the intermediate transfer belt 3. Then, the pair of registration rollers 2 starts driving to convey the sheet P in synchrony with the timing to transfer the toner image onto the sheet P by a secondary transfer roller 4, so that the toner image is transferred onto the sheet P by the secondary transfer roller 4. Then, the fixing device 150 fixes the toner on the image to the sheet P. To be more specific, the fixing device 50 includes a fixing roller 5 having a heater 25 inside the fixing roller 5 and a pressure roller 35. The sheet P having the toner image is conveyed to a pressing portion of the fixing roller 5 and the pressure roller 35, so that the toner on the image (toner image) to the sheet P by application of heat and pressure.

When performing single-side printing, the sheet P is conveyed in the sheet ejecting device 160 while being held between a sheet ejection roller 7 and a sheet ejection counter roller 37, and then ejected to a sheet ejection tray 27.

When performing duplex printing, after having passed through the pressing portion of the fixing roller 5 and the pressure roller 35, the trailing end of the sheet P is detected by a sheet ejection sensor mounted on the sheet reversing guide 6. In synchrony with the timing at which the trailing end of the sheet P has passed by the top of the sheet reversing guide 6, the sheet ejection roller 7 is rotated in a reverse direction that is opposite a forward direction in which the sheet P is conveyed to be ejected to the outside of the image forming apparatus 100. The sheet ejection roller 7 is controlled to be driven by a stepping motor, so that the sheet ejection roller 7 is controlled to rotate either the forward direction or the reverse direction according to the detection result of the sheet ejection sensor. In the present embodiment, a plurality of sheet ejection rollers 7*a*, 7*b*, 7*c*, and 7*d* is disposed along the axial direction (see FIG. 5). However, the plurality of sheet ejection rollers 7*a*, 7*b*, 7*c*, and 7*d* is referred to in singular form as the sheet ejection roller 7, for convenience. After the sheet ejection roller 7 has started rotating in the reverse direction, the sheet P reaches a duplex print roller 8 provided in the sheet reentry device 170, where the sheet P turns to reach the pair of registration rollers 2 again. At the pair of registration rollers 2, the sheet P stands by while being bent (warped). Thereafter, similar to the operations performed in the single-side printing, an image is formed on the sheet P by secondary transfer and fusing, and then the sheet P is ejected to a sheet ejection tray 27.

As illustrated in FIG. 2, the sheet conveying device 200 further includes a lower sheet ejection guide 11 and an upper sheet ejection guide 12, both provided in the sheet ejecting device 160. In addition, the sheet conveying device 200 includes an outer guide 38 provided in the sheet reentry device 170.

Figure 3:
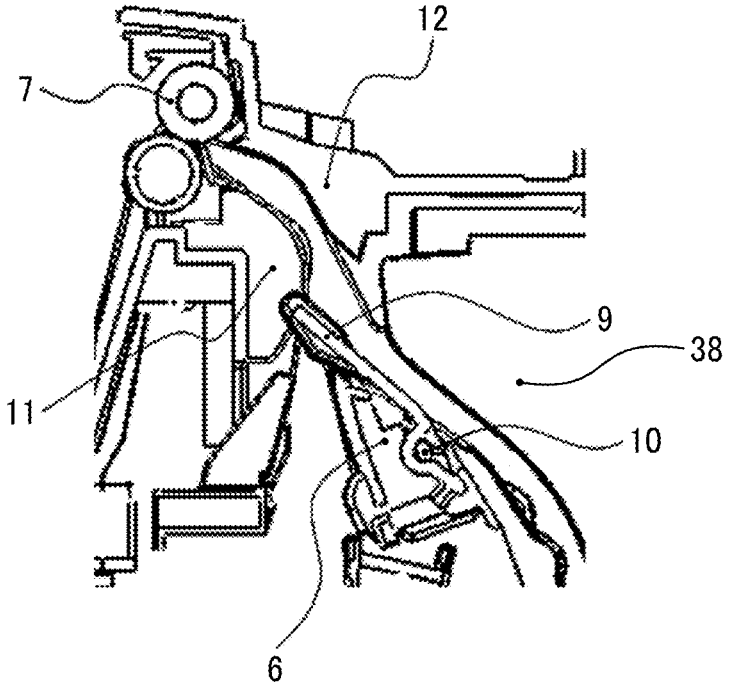
FIG. 3 is an enlarged view illustrating a sheet reversing guide that is a sheet reversing portion and the periphery of the sheet reversing guide.

FIG. 3 is an enlarged view illustrating the sheet reversing guide 6 that is a sheet reversing portion and the periphery of the sheet reversing guide 6.

The lower sheet ejection guide 11 is a sheet conveyance guide that supports the sheet ejection roller 7, so as to guide the image formed side of the sheet P. The upper sheet ejection guide 12 is a sheet conveyance guide that guides the sheet P to the sheet ejection roller 7. The sheet reversing guide 6 defines sheet conveyance passages on the left and right sides of FIG. 3. A sheet ejection passage P1 runs on the left side of FIG. 3 and a sheet reversal passage P2 runs on the right side of FIG. 3. The left side of the sheet reversing guide 6 guides the non-image forming face of the sheet P when the sheet P is ejected to the outside of the image forming apparatus 100 or before the sheet P is reversed for duplex printing. The right side of the sheet reversing guide 6 guides the sheet P after being reversed toward the duplex print roller 8, together with the outer guide 38. In other words, the sheet reversal passage P2 is partly defined by the sheet reversing guide 6 and the outer guide 38.

A conveyance passage branching guide 9 is movably disposed on the sheet reversing guide 6. The conveyance passage branching guide 9 functions as a branching guide to switch passages when the sheet P is reversed. The conveyance passage branching guide 9 is rotatably supported by a rotary shaft 10 that functions as a rotation fulcrum and a rotational support movably disposed on the sheet reversing guide 6. In other words, the rotary shaft 10 rotatably supports the conveyance passage branching guide 9. According to this structure, the sheet reversing guide 6 does not employ a drive unit such as a solenoid. Further, the sheet reversing guide 6 does not include a biasing member such as a spring, and therefore the conveyance passage branching guide 9 moves by being pushed up by the sheet when the sheet P is conveyed or by the own weight.

A description is given of the functions of the conveyance passage branching guide 9.

The branch portion of the conveyance passage for ejecting a sheet (i.e., the sheet ejection passage P1) and the conveyance passage for reversing a sheet for duplex printing (i.e., the sheet reversal passage P2) increases in space, and therefore the sheet is not conveyed stably. Further, since the branch portion is located immediately after the fixing device 150, the sheet may be largely affected by curling. For example, when the leading end of a sheet has a significant back-edge curl (in other words, when the lateral outside of the leading end of the sheet is curled to the right side of FIG. 3, toward the sheet reversing guide 6 relative to the center of the sheet in the width direction of the sheet), in a case in which the conveyance passage branching guide 9 is not provided on the sheet reversing guide 6, the incidence angle of the leading end of the sheet with the curl increases as the sheet travels by the sheet reversing guide 6 toward the upper sheet ejection guide 12. Therefore, when the sheet reaches the upper sheet ejection guide 12, the sheet may have at least one of leading end fold, sheet edge folding error, and paper jam. Further, when the leading end of the sheet has a face curl (a curl to the left side of FIG. 3) or a large side curl after the sheet has started reversing the sides, the sheet may reenter the conveyance passage on the side of the fixing device 150 (i.e., the sheet ejection passage P1), without being guided to the sheet reversal passage P2 toward the duplex print roller 8. Therefore, the conveyance passage branching guide 9 is provided to convey a sheet reliably, regardless of the state of the curl.

Figure 4A:
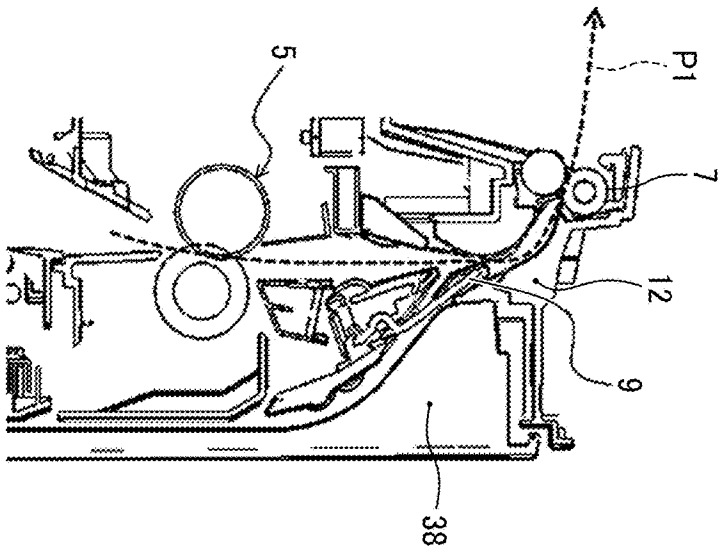
FIGS. 4A and 4B are diagrams illustrating movements of a conveyance passage branching guide.
Figure 4B:
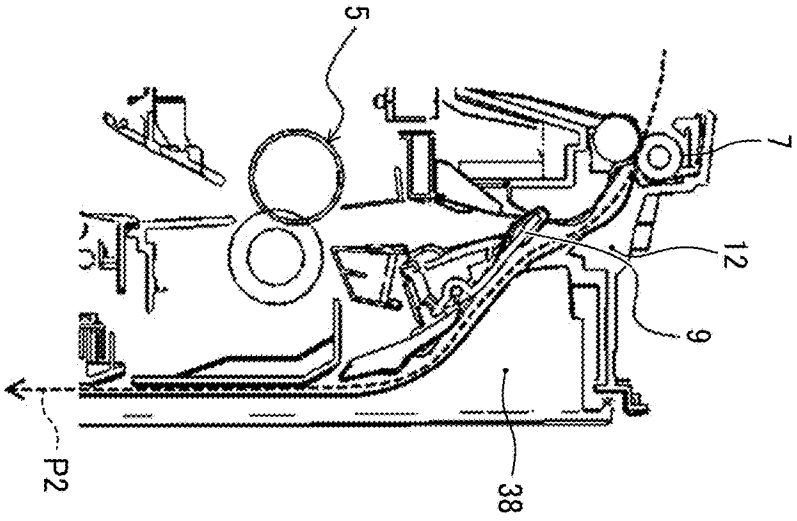

FIGS. 4A and 4B are diagrams illustrating movements of the conveyance passage branching guide 9.

A description is given of movements of the conveyance passage branching guide 9 when the sheet P is reversed, with reference to FIG. 4.

After being ejected from the fixing device 150 by the fixing roller 5, the sheet P travels in the sheet ejection passage P1 in a first direction that is a sheet ejection direction and reaches the conveyance passage branching guide 9. Then, the leading end of the sheet P lifts up the conveyance passage branching guide 9, so that the sheet P is transferred (conveyed) to the upper sheet ejection guide 12. The posture of the conveyance passage branching guide 9 in which the conveyance passage branching guide 9 is lifted by the sheet P corresponds to a first sheet guiding position to guide the sheet P in the first direction. Thereafter, the sheet P is conveyed to the sheet ejection roller 7. After the trailing end of the sheet P has passed by the conveyance passage branching guide 9, the conveyance passage branching guide 9 returns to a standby position by the own weight of the conveyance passage branching guide 9. The standby position is a home position of the conveyance passage branching guide 9. When the conveyance passage branching guide 9 is at the home position (standby position), the conveyance passage branching guide 9 is blocking the sheet ejection passage P1. Therefore, the standby position corresponds to a second sheet guiding position to guide the sheet P in a second direction. Thereafter, the sheet ejection roller 7 is rotated in the reverse direction to guide the sheet P on the upper side of the conveyance passage branching guide 9, so that the sheet P is conveyed in the second direction and guided to the duplex print roller 8 (the sheet reversal passage P2).

According to the movements as described above, the conveyance passage branching guide 9 is switchable between the first sheet guiding position and the second sheet guiding position. In other words, by moving the conveyance passage branching guide 9, the position of the conveyance passage branching guide 9 is switched between the first sheet guiding position and the second sheet guiding position. Specifically, the conveyance passage branching guide 9 moves from the second sheet guiding position to the first sheet guiding position in response to contact of the leading end of the sheet P to the conveyance passage branching guide 9 at the second sheet guiding position. Similarly, the conveyance passage branching guide 9 moves from the first sheet guiding position to the second sheet guiding position in response to passing of the trailing end of the sheet P by the conveyance passage branching guide 9 at the first sheet guiding position.

Note that the sheet ejection passage P1 and the sheet reversal passage P2 are provided on opposite sides of the rotary shaft 10. According to this layout of the conveyance passages in the sheet conveying device 200, even when the conveyance passage branching guide 9 has a relatively simple structure, the conveyance passage branching guide 9 guides the sheet P stably by selectively changing the position between the second sheet guiding position that blocks the sheet ejection passage P1 and the first sheet guiding position that opens the sheet ejection passage P1.

The following two matters are to be considered on the conveyance passage branching guide 9.

The first matter to be considered is that: when the sheet P lifts up the conveyance passage branching guide 9, a load is applied onto the leading end of a sheet P. Therefore, the conveyance passage branching guide 9 is to have an appropriate weight so as to lift up the leading end of the sheet P even when the sheet P is a thin paper or a small size sheet.

The second matter to be considered is that: the conveyance passage branching guide 9 that is lifted by the leading end of the sheet P is to have returned to the home position (the standby position) after the trailing end of the sheet P has passed by the conveyance passage branching guide 9 and the sheet ejection roller 7 has been rotated in the reserve direction and before the sheet P reaches the conveyance passage branching guide 9 again. The conveyance passage branching guide 9 having a relatively large (heavy) weight is given a relatively large impact when the conveyance passage branching guide 9 returns to the home position, so that the conveyance passage branching guide 9 may bounce back and forth. Therefore, the time the conveyance passage branching guide 9 returns to the home position is not determined reliably. This problem is solvable by a configuration provided with a solenoid to drive the conveyance passage branching guide 9. However, it may be difficult to employ the configuration to a low-cost, space-saving device. Further, a spring may be employed to the conveyance passage branching guide 9 in order to achieve an earlier return time. In that case, however, the load to the leading end of the sheet, which is the first matter to be considered, further increases.

As an example, a known sheet conveying device includes a conveyance passage branching guide disposed where a first sheet conveyance passage, through which a sheet passes in a first direction, meets a second sheet conveyance passage, which shares a part of the first sheet conveyance passage and branches off from the first sheet conveyance passage in a second direction opposite the first direction of the part of the first sheet conveyance passage. The conveyance passage branching guide is switchable between a first position at which the sheet is guided in the first direction and a second position at which the sheet is guided in the second direction. The known sheet conveying device further includes a coil spring and a solenoid to apply force against the biasing force of the coil spring. The conveyance passage branching guide is switchable between a first position, at which the sheet is guided in the first direction, and a second position, at which the sheet is guided in the second direction, by the coil spring and the solenoid.

However, since the known sheet conveying device employs an actuator such as the solenoid that electrically controls the mechanism, the cost of the known sheet conveying device increases.

In consideration of the above two matters, in the present embodiment, a plurality of conveyance passage branching guides 9*a*, 9*b*, 9*c*, 9*d*, and 9*e* is provided on the sheet reversing guide 6. The plurality of conveyance passage branching guides 9*a*, 9*b*, 9*c*, 9*d*, and 9*e*, each of which having a narrow width, is disposed spaced apart from each other to be separately movable.

Figure 5:
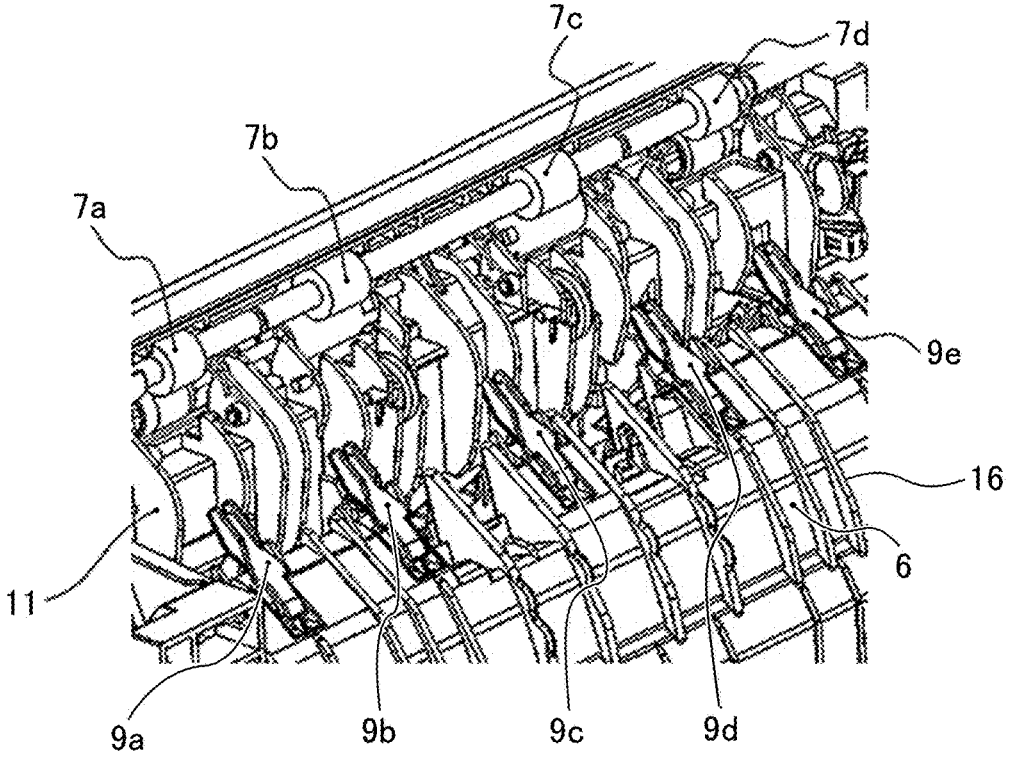
FIG. 5 is a diagram illustrating the layout of a plurality of conveyance passage branching guides.

FIG. 5 is a diagram illustrating the layout of the plurality of conveyance passage branching guides 9*a*, 9*b*, 9*c*, 9*d*, and 9*e*. Note that FIG. 5 is a perspective view illustrating the sheet reversing guide 6 that is a sheet reversing portion and the periphery of the sheet reversing guide 6, without the upper sheet ejection guide 12 and the outer guide 38.

As illustrated in FIG. 5, five (5) conveyance passage branching guides 9 with suffixes a, b, c, d, and e, which is the plurality of conveyance passage branching guides 9*a*, 9*b*, 9*c*, 9*d*, and 9*e*, are provided on the sheet reversing guide 6. Note that the sheet reversing guide 6 further includes ribs 16 on the side along which the sheet P after reversal is guided. The ribs 16 on the sheet reversing guide 6 guide the sheet P while contacting the sheet P.

With the narrow width, the weight of each of the plurality of conveyance passage branching guides 9*a*, 9*b*, 9*c*, 9*d*, and 9*e* is reduced. When compared to a case when conveying a relatively large size sheet, the number of the plurality of conveyance passage branching guides 9*a*, 9*b*, 9*c*, 9*d*, and 9*e* to be lifted is reduced when conveying a relatively small size sheet. Therefore, the load applied to the leading end of the sheet P is reduced, preventing damage on the sheet P.

In addition, with a relatively small (light) weight, each of the plurality of conveyance passage branching guides 9*a*, 9*b*, 9*c*, 9*d*, and 9*e* is given a relatively small impact when the plurality of conveyance passage branching guides 9*a*, 9*b*, 9*c*, 9*d*, and 9*e* returns to the home position, and therefore may bounce back and forth by a smaller amount. Therefore, the quietness and productivity are enhanced. Accordingly, the plurality of conveyance passage branching guides 9*a*, 9*b*, 9*c*, 9*d*, and 9*e* saves sufficient time before reversing the sheet P. In addition, the plurality of conveyance passage branching guides 9*a*, 9*b*, 9*c*, 9*d*, and 9*e* is not provided with respective springs to return to the home position, reducing the load to be applied to the leading end of the sheet P. As a result, a thin paper is conveyable in the sheet conveying device 200.

Figure 6A:
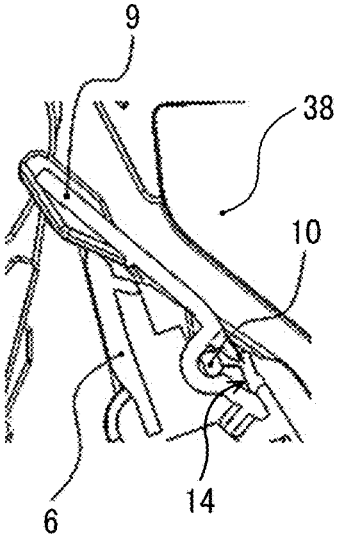
FIGS. 6A and 6B are diagrams illustrating rotation of the conveyance passage branching guide.
Figure 6B:
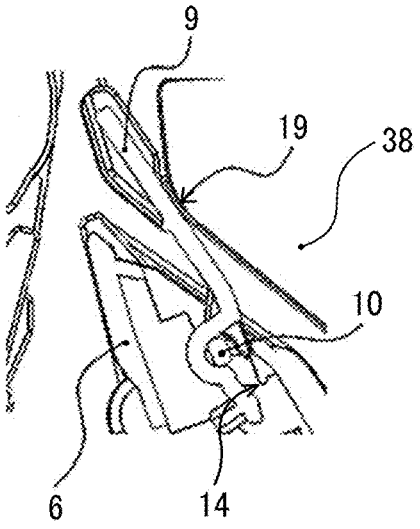

FIGS. 6A and 6B are diagrams illustrating respective rotations of the plurality of conveyance passage branching guides 9*a*, 9*b*, 9*c*, 9*d*, and 9*e*.

Note that, due to the structures identical to each other, hereinafter, the plurality of conveyance passage branching guides 9*a*, 9*b*, 9*c*, 9*d*, and 9*e* may collectively be referred to as the conveyance passage branching guide 9.

As illustrated in FIGS. 6A and 6B, the conveyance passage branching guide 9 is rotatably supported by the rotary shaft 10 that is movably disposed on the sheet reversing guide 6.

Also, as illustrated in FIGS. 6A and 6B, a standby rotation stopper 14 that functions as a rib-shaped (rotation) stopper is provided on the sheet reversing guide 6.

As illustrated in FIG. 6A, at the standby position, the conveyance passage branching guide 9 rotates due to the moment of inertia (rotational inertia) about the rotary shaft 10 caused by the own weight of the conveyance passage branching guide 9 to contact the standby rotation stopper 14. To be more specific, the conveyance passage branching guide 9 has a contact portion at which the conveyance passage branching guide 9 contacts the standby rotation stopper 14. The contact portion of the conveyance passage branching guide 9 is located opposite the center of gravity of the conveyance passage branching guide 9 across the rotary shaft 10 as a rotation fulcrum of the conveyance passage branching guide 9. The conveyance passage branching guide 9 stops and holds the second sheet guiding position at the standby rotation stopper 14 while being in contact with the standby rotation stopper 14.

As illustrated in FIG. 6B, an upward rotation stopper 19 having a rib shape is provided on the outer guide 38, which is disposed opposite from the sheet reversing guide 6 across the second sheet reversal passage P2. As illustrated in FIG. 6B, when being lifted up by the leading end of the sheet P, the conveyance passage branching guide 9 contacts the upward rotation stopper 19. At this position at which the conveyance passage branching guide 9 is in contact with the upward rotation stopper 19, even when the curl of the sheet P is taken into consideration, the sheet P is conveyed to the upper sheet ejection guide 12 reliably.

Figure 7:
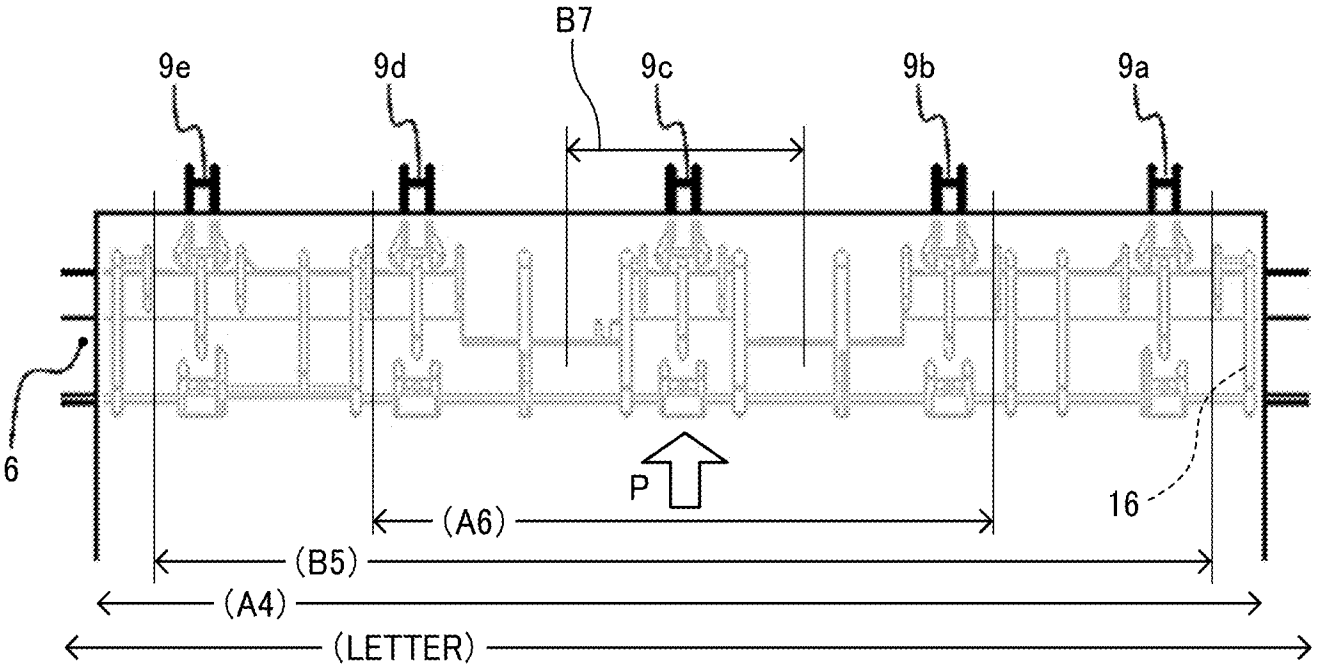
FIG. 7 is a diagram illustrating the plurality of conveyance passage branching guides when conveying a sheet having the maximum width acceptable in the sheet conveying device.
Figure 8:
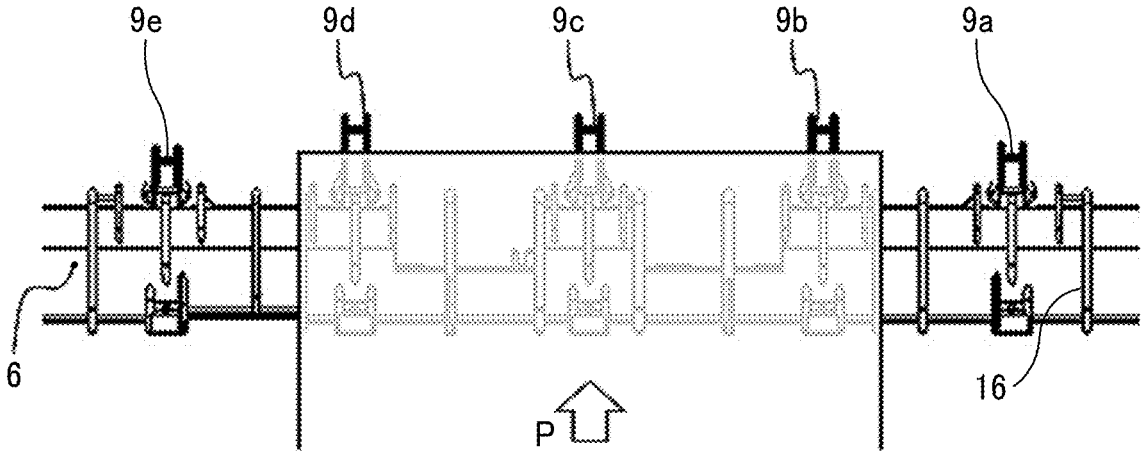
FIG. 8 is a diagram illustrating the plurality of conveyance passage branching guides when conveying a small size sheet (for example, A6 size sheet) in the sheet conveying device.
Figure 9:
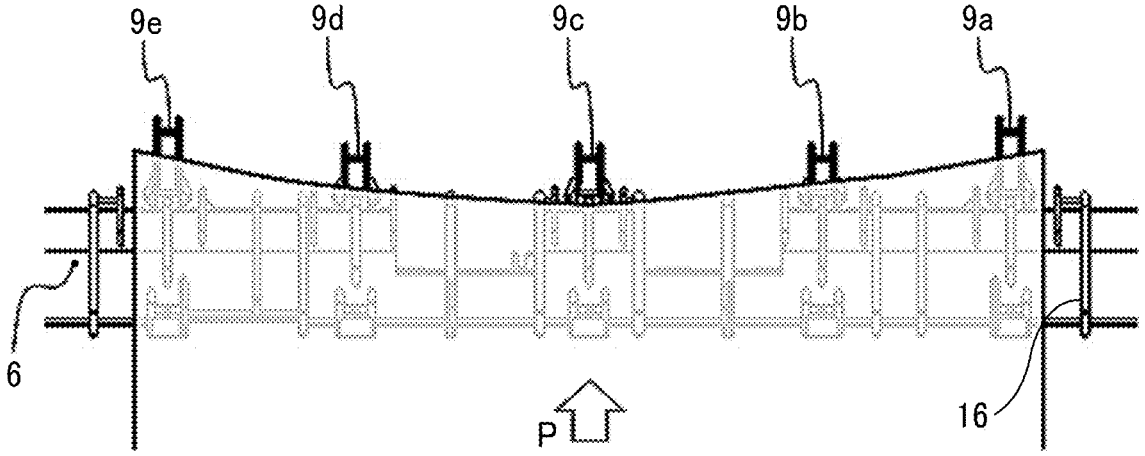
FIG. 9 is a diagram illustrating the plurality of conveyance passage branching guides when conveying a sheet having a side curl.

FIGS. 7, 8, and 9 are diagrams for explaining the states of (movements of) the plurality of conveyance passage branching guides 9*a* to 9*e* when a sheet of each size arrives at the plurality of conveyance passage branching guides 9*a* to 9*e*. Each drawing is a view of the plurality of conveyance passage branching guides 9*a* to 9*e* along the width direction when a sheet has arrived at the plurality of conveyance passage branching guides 9*a* to 9*e*, viewed from the image forming face of the sheet P (in other words, from the lower sheet ejection guide 11).

FIG. 7 is a diagram illustrating the plurality of conveyance passage branching guides 9*a* to 9*e* when conveying a sheet having the maximum width acceptable in the sheet conveying device 200.

The plurality of conveyance passage branching guides 9*a* to 9*e*, which is provided at five (5) positions in the width direction of the sheet P is lifted up substantially at the same time. Therefore, the total weight of five of the plurality of conveyance passage branching guides 9 (i.e., the conveyance passage branching guides 9*a* to 9*e*) is applied onto the leading end of the sheet P. At this time, since the rigidity of the sheet P is the weakest at the end portions, the positions of the plurality of conveyance passage branching guides 9*a* to 9*e* in the width direction of the sheet P are set not to cause sheet edge folding error on the end portions.

As illustrated in FIG. 7, the plurality of conveyance passage branching guides 9*a* to 9*e* is disposed so as not to overlap the end positions of a sheet of the standard sizes such as the A series sheets, the B series sheets, and Letter size sheets. This placement of the plurality of conveyance passage branching guides 9*a* to 9*e* is made to prevent sheet edge folding error caused by contact of the end portion of the sheet to the side face of the plurality of conveyance passage branching guides 9*a* to 9*e* when the position of the side face of the plurality of conveyance passage branching guides 9*a* to 9*e* matches the position of the end portion of the sheet P.

FIG. 8 is a diagram illustrating the plurality of conveyance passage branching guides 9*a* to 9*e* when conveying a small size sheet (for example, A6 size sheet) in the sheet conveying device 200.

In this case, that is, when a small size sheet is conveyed, of the plurality of conveyance passage branching guides 9*a* to 9*e*, three (3) conveyance passage branching guides 9*b*, 9*c*, and 9*d* disposed at the center in the width direction of the sheet P are lifted and two (2) conveyance passage branching guides 9*a* and 9*e* disposed at both ends in the width direction of the sheet P are not lifted. With this configuration, the load applied to the leading end of the sheet P is reduced, and therefore no error such as a leading end fold error occurs.

FIG. 9 is a diagram illustrating the plurality of conveyance passage branching guides 9*a* to 9*e* when conveying a sheet having a side curl (in other words, a back-edge curl when the end portions in the width direction of the sheet P is closer to the sheet reversing guide 6 than the center portion in the width direction of the sheet P).

In this case, that is, when a sheet having a side curl is conveyed, the end portions of the sheet P reach the conveyance passage branching guides 9*a* and 9*e* before the center portion of the sheet P reaches the conveyance passage branching guides 9*b*, 9*c*, and 9*d*. Within the width of the conveyance passage, the center portion of the sheet P is conveyed along the lower sheet ejection guide 11 and the end portions of the sheet P are conveyed along the sheet reversing guide 6. Therefore, the center portion of the sheet P reaches near the distal end (free end) of the conveyance passage branching guide 9 and the end portions of the sheet P reach near the proximal end (root end) of the conveyance passage branching guide 9, which generates a time difference of arrival of the sheet P between each of the conveyance passage branching guides 9*b*, 9*c*, and 9*d* and each of the conveyance passage branching guides 9*a* and 9*e*. However, since the load that is applied to the end portions of the sheet P is divided into the amount of a single end portion when the load is applied to each of the end portions of the sheet P. Therefore, the placement of the plurality of conveyance passage branching guides 9*a* to 9*e* in FIGS. 7 to 9 is effective to prevent sheet edge folding error.

As described above, the plurality of conveyance passage branching guides 9*a* to 9*e* is disposed so as not to overlap the end positions of a sheet of the standard sizes. However, a user may use a non-standard size sheet. Therefore, it is preferable to provide the following configuration.

Figure 10:
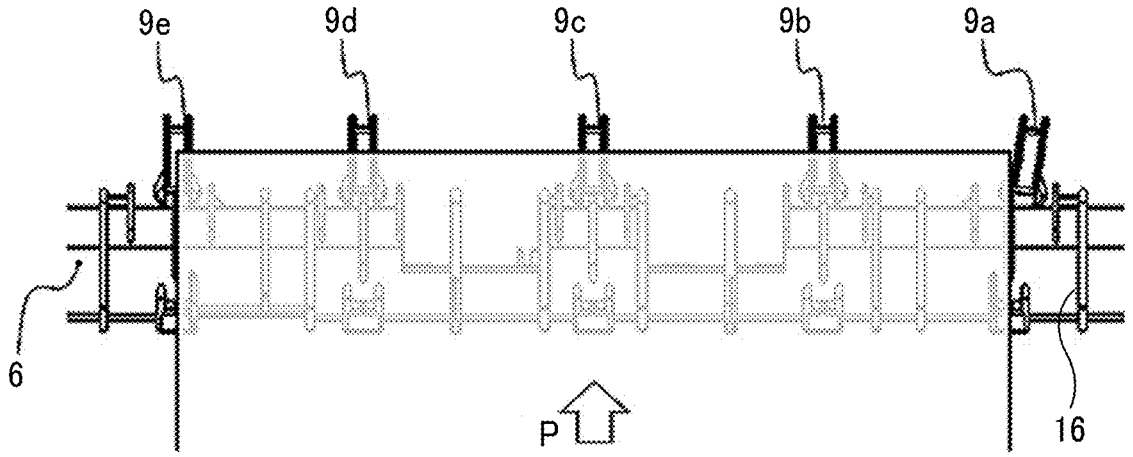
FIG. 10 is a diagram illustrating the plurality of conveyance passage branching guides in a state in which the edge of a sheet is in contact with the conveyance passage branching guide.

FIG. 10 is a diagram illustrating the plurality of conveyance passage branching guides 9*a* to 9*e* in a state in which an end portion of the sheet P is in contact with the conveyance passage branching guide 9*a*.

As illustrated in FIG. 10, each of the plurality of conveyance passage branching guides 9*a* to 9*e* has a play in which each of the plurality of conveyance passage branching guides 9*a* to 9*e* is slantable in the width direction of the sheet P (in other words, toward a direction having a width direction component of the sheet P). To be more specific, a play is provided in the radial direction of the rotary shaft 10 in FIG. 6. With this configuration, even when the end portion of the sheet P contacts the side face of the conveyance passage branching guide 9 (the conveyance passage branching guide 9*a* in FIG. 10), the conveyance passage branching guide 9 moves outward to prevent occurrence of sheet edge folding error. The amount of slant of the conveyance passage branching guide 9 is adjusted depending on the amount of play in the radial direction of the rotary shaft 10 in FIG. 6.

Figure 11:
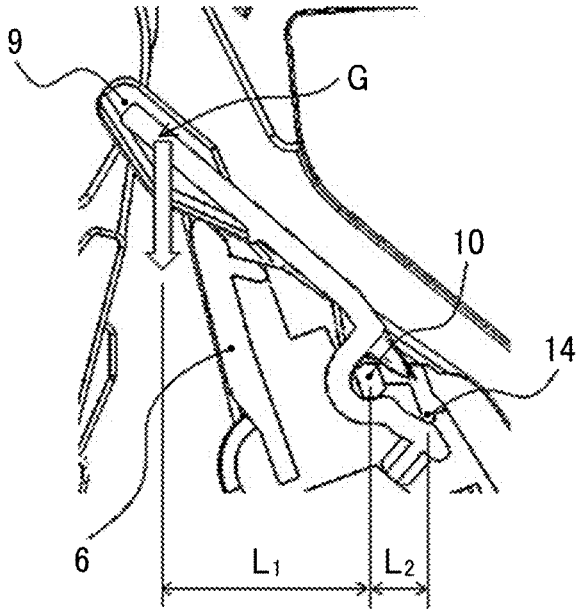
FIG. 11 is a diagram illustrating a standby position of the conveyance passage branching guide.

FIG. 11 is a diagram illustrating a standby position of the conveyance passage branching guide 9.

When the conveyance passage branching guide 9 returns to the home position by the own weight, it is preferable to reduce the impact to restrain the delay of the returning time due to bouncing of the conveyance passage branching guide 9 and the impact noise. In order to achieve the above-described reduction in impact of the conveyance passage branching guide 9, as illustrated in FIG. 11, it is preferable to provide a distance $L_2$ from the rotary shaft 10 to the standby rotation stopper 14 significantly shorter (smaller) than a distance $L_1$ from the rotary shaft 10 to the center of gravity G. For example, the rate of the distance $L_1$ and the distance $L_2$ is set to approximately 3:1. This rate is set so that the moment of inertia (rotational inertia) about the rotary shaft 10 caused by the own weight of the conveyance passage branching guide 9 preferably contributes to prompt convergence of bouncing of the conveyance passage branching guide 9.

Figure 12A:
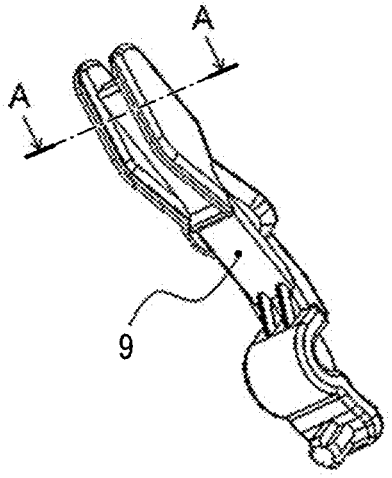
FIGS. 12A, 12B, and 12C are diagram illustrating a configuration of sheet conveyance ribs of the conveyance passage branching guide.
Figure 12B:
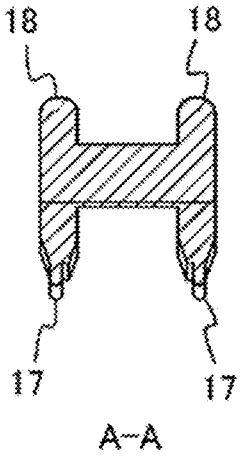
Figure 12C:
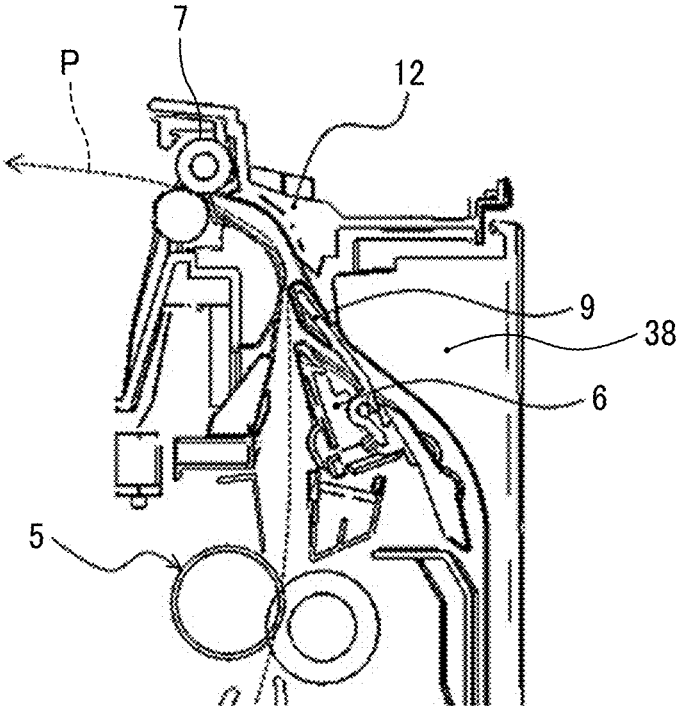

FIGS. 12A, 12B, and 12C are diagram illustrating a configuration of sheet conveyance ribs of the conveyance passage branching guide 9.

As illustrated in FIGS. 12A and 12B, it is preferable that the conveyance passage branching guide 9 has sheet conveyance ribs on the sheet ejection side (the position facing the lower sheet ejection guide 11) in the sheet ejection passage P1 and on the sheet reversal side in the sheet reversal passage P2. FIG. 12B is a cross sectional view illustrating the conveyance passage branching guide 9, taken along a line A-A of FIG. 12A. On the conveyance passage branching guide 9, sheet ejection side ribs 17 and sheet reversal side ribs 18 are provided.

As viewed along the sheet conveyance passage (i.e., the sheet ejection passage P1), the conveyance passage branching guide 9 is disposed right above the fixing roller 5. Due to this layout, condensation tends to occur by water vapor generated when a sheet passes by the fixing roller 5. In order to prevent such condensation, each sheet ejection side rib 17 projects from the root (proximal end) on the conveyance passage branching guide 9 and tapers toward the tip (distal end), as illustrated in the cross sectional view of FIG. 12B. In other words, the root of each sheet ejection side rib 17 is thicker than the tip. This shape of each sheet ejection side rib 17 prevents the tip from adhesion of water droplets due to condensation. Since the sheet ejection side ribs 17 are relatively thin, the area to which water droplets attach is reduced. Further, since the amount of thermal capacity decreases, the tip of each sheet ejection side rib 17 is easily warmed up, condensation is less likely to occur. Similarly, the sheet reversing guide 6 and the upper sheet ejection guide 12 illustrated in FIG. 12C are also disposed above the fixing roller 5, and therefore water droplets collect easily. In order to address this inconvenience, the sheet P is biased by the conveyance passage branching guide 9 as illustrated in FIG. 12C, so that the sheet P is conveyed while strictly preventing contacting the sheet reversing guide 6 and the upper sheet ejection guide 12. Accordingly, the sheet is prevented from adhesion of water droplet.

In the above-described embodiment, each of the plurality of conveyance passage branching guides 9*a* to 9*e* is configured to return to the standby position by the own weight. However, the structure of the plurality of conveyance passage branching guides 9*a* to 9*e* is not limited to the above-described structure. For example, the conveyance passage branching guide 9 may employ a light spring to assist the return to the standby position, as described in the following aspects.

The first aspect is a configuration in which a spring having lighter (weaker) force is provided to each of the plurality of conveyance passage branching guides 9*a* to 9*e*, in other words, at five (5) positions corresponding to the plurality of conveyance passage branching guides 9*a* to 9*e*. This placement of five springs is to assist each conveyance passage branching guide 9 when decurling the curl of the sheet P, returning to the home position, or both.

The second aspect is a configuration in which a spring is provided to two (2) of the plurality of conveyance passage branching guides 9*a* to 9*e*, to be more specific, a spring is provided to the conveyance passage branching guides 9*a* and 9*e* disposed at both ends of the plurality of conveyance passage branching guides 9*a* to 9*e*. Since a sheet with the wider width tends to have a stronger curl, a spring is provided to the conveyance passage branching guides 9*a* and 9*e* disposed at both ends of the plurality of conveyance passage branching guides 9*a* to 9*e*, so as to restrain the curl of the sheet.

The third aspect is a configuration in which a spring is provided to four (4) of the plurality of conveyance passage branching guides 9*a* to 9*e*, to be more specific, a spring is provided to the conveyance passage branching guides 9*a*, 9*b*, 9*e*, and 9*e*, other than the conveyance passage branching guide 9*c* that is disposed at the center. The reasons why the conveyance passage branching guide 9*c* is not provided with a spring are: even when a small, thin paper that contacts one conveyance passage branching guide 9, i.e., the conveyance passage branching guide 9*c* disposed at the center, is conveyed, the small, thin paper is capable of lifting up the conveyance passage branching guide 9*c*; and when a large sheet that contacts five (5) of the plurality of conveyance passage branching guides 9*a* to 9*e* is conveyed, the springs of the conveyance passage branching guides 9*a*, 9*b*, 9*e*, and 9*e* are capable of assisting the conveyance passage branching guide 9*c* to decurl the sheet (correct the curl of the sheet) and return to the home position reliably.

Figure 13:
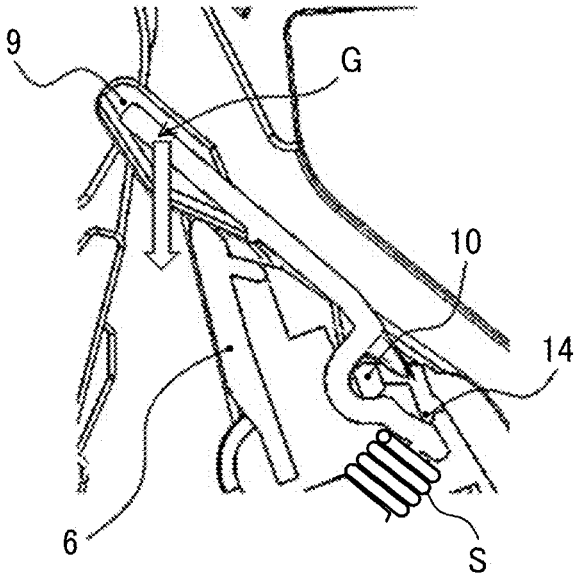
FIG. 13 is a diagram illustrating the conveyance passage branching guide of Variation.

Note that FIG. 13 is a diagram illustrating the conveyance passage branching guide 9 of Variation. A spring may be disposed at the position of a spring S illustrated in FIG. 13.

The effects described in the embodiments of this disclosure are listed as most preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of the invention, and are included in the scope of the invention recited in the claims and its equivalent.

Any one of the above-described operations may be performed in various other ways, for example, in an order different from the one described above.

What is claimed is:

1. A sheet conveying device comprising:

a first sheet conveyance passage through which a sheet passes in a first direction;

a second sheet conveyance passage sharing a part of the first sheet conveyance passage and branching off from the first sheet conveyance passage in a second direction opposite the first direction of the first sheet conveyance passage; and a branching guide disposed at a position where the first sheet conveyance passage meets the second sheet conveyance passage, the branching guide to move between a first position in which the sheet is guided in the first direction and a second position in which the sheet is guided in the second direction, a plurality of branching guides, including the branching guide, being spaced apart in a width direction of the sheet and separately switchable between the first position and the second position, a rotary shaft to rotatably support the branching guide; and a stopper to which the branching guide contacts, wherein the branching guide includes a contact portion to contact the stopper and located opposite a center of gravity of the branching guide across the rotary shaft, wherein the branching guide is configured to rotate about the rotary shaft and contact the stopper at the contact portion to hold the second position, and wherein a distance from the contact portion to a center of the rotary shaft is shorter than a distance from the center of the rotary shaft to the center of gravity of the branching guide.

2. The sheet conveying device according to claim 1, wherein the branching guide is to move from the second position to the first position in response to contact of a leading end of the sheet to the branching guide at the second position, and wherein the branching guide is to move from the first position to the second position in response to passing of a trailing end of the sheet by the branching guide at the first position.

3. The sheet conveying device according to claim 2, wherein at least one of the plurality of branching guides is to move to the second position due to an own weight of the at least one of the plurality of branching guides.

4. The sheet conveying device according to claim 1, wherein:

each of the plurality of branching guides has play which allows said each of the plurality of branching guides to be slantable in a direction corresponding to the width direction of the sheet.

5. The sheet conveying device according to claim 1, wherein each of the plurality of branching guides includes a rib to contact the sheet, wherein each of the ribs projects from each of the plurality of branching guides toward the first sheet conveyance passage, and wherein each of the ribs tapers toward the first sheet conveyance passage.

6. The sheet conveying device according to claim 1, wherein:

the rotary shaft is disposed between the first sheet conveyance passage and the second sheet conveyance passage.

7. An image forming apparatus comprising:

an image forming device to form an image on a sheet; and the sheet conveying device according to claim 1, to convey the sheet.

8. The image forming apparatus according to claim 7, wherein the first sheet conveyance passage is a sheet ejection passage, through which the sheet having the image formed by the image forming device is conveyed to an outside of the image forming apparatus, and wherein the second sheet conveyance passage is a sheet reversal passage, through which the sheet conveyed in the first sheet conveyance passage in the first direction is reversed toward the image forming device again.

9. A sheet conveying device comprising:

a first sheet conveyance passage through which a sheet passes in a first direction;

a second sheet conveyance passage sharing a part of the first sheet conveyance passage and branching off from the first sheet conveyance passage in a second direction opposite the first direction of the first sheet conveyance passage; and a branching guide disposed at a position where the first sheet conveyance passage meets the second sheet conveyance passage, the branching guide to move between a first position in which the sheet is guided in the first direction and a second position in which the sheet is guided in the second direction, a plurality of branching guides, including the branching guide, being spaced apart in a width direction of the sheet and separately switchable between the first position and the second position, the sheet conveying device further comprising a rotary shaft to rotatably support the plurality of branching guides, wherein at least one of the plurality of branching guides includes play which allows said at least one of the plurality of branching guides to be slantable in a direction corresponding to the width direction of the sheet.

10. The sheet conveying device according to claim 9, wherein the branching guide is to move from the second position to the first position in response to contact of a leading end of the sheet to the branching guide at the second position, and wherein the branching guide is to move from the first position to the second position in response to passing of a trailing end of the sheet by the branching guide at the first position.

11. The sheet conveying device according to claim 9, wherein at least one of the plurality of branching guides is configured to move to the second position due to an own weight of the at least one of the plurality of branching guides.

12. The sheet conveying device according to claim 9, further comprising:

a stopper to which the branching guide contacts, wherein the branching guide has a contact portion to contact the stopper and located opposite a center of gravity of the branching guide across the rotary shaft, wherein the branching guide is to rotate about the rotary shaft and contact the stopper at the contact portion to hold the second position, and wherein a distance from the contact portion to a center of the rotary shaft is shorter than a distance from the center of the rotary shaft to the center of gravity of the branching guide.

13. The sheet conveying device according to claim 9, wherein each of the plurality of branching guides includes a rib to contact the sheet, wherein each of the ribs projects from each of the plurality of branching guides toward the first sheet conveyance passage, and wherein each of the ribs tapers toward the first sheet conveyance passage.

14. The sheet conveying device according to claim 9, wherein:

the rotary shaft is disposed between the first sheet conveyance passage and the second sheet conveyance passage.

15. An image forming apparatus comprising:

an image forming device to form an image on a sheet; and the sheet conveying device according to claim 9, to convey the sheet.

16. The image forming apparatus according to claim 15, wherein the first sheet conveyance passage is a sheet ejection passage, through which the sheet having the image formed by the image forming device is conveyed to an outside of the image forming apparatus, and wherein the second sheet conveyance passage is a sheet reversal passage, through which the sheet conveyed in the first sheet conveyance passage in the first direction is reversed toward the image forming device again.

17. The sheet conveying device according to claim 9, wherein:

each of the plurality of branching guides includes play which allows said each of the plurality of branching guides to be slantable in the direction corresponding to the width of the sheet.

* * * * *